US008555571B2

(12) United States Patent
Darmer et al.

(10) Patent No.: US 8,555,571 B2
(45) Date of Patent: Oct. 15, 2013

(54) SKYLIGHT WITH DISPLACEMENT ABSORBER AND INTERLOCKING TELESCOPING TUBES

(75) Inventors: Samuel H. Darmer, Greenwood, SC (US); Jeffrey J. Ronan, Greenwood, SC (US)

(73) Assignee: VKR Holding A/S, Horshølm (DK)

( * ) Notice: Subject to any disclaimer, the term of this patent is extended or adjusted under 35 U.S.C. 154(b) by 1753 days.

(21) Appl. No.: 10/754,975

(22) Filed: Jan. 9, 2004

(65) Prior Publication Data

US 2005/0166490 A1 Aug. 4, 2005

(51) Int. Cl.
*E04B 7/18* (2006.01)

(52) U.S. Cl.
USPC ..... 52/200

(58) Field of Classification Search
USPC ..... 52/200; 126/307, 307 R
See application file for complete search history.

(56) References Cited

U.S. PATENT DOCUMENTS

| | | | | | |
|---|---|---|---|---|---|
| D243,851 | S | * | 3/1977 | Felter | D23/373 |
| 4,339,900 | A | * | 7/1982 | Freeman | 52/200 |
| 4,522,191 | A | * | 6/1985 | Knowles et al. | 126/307 R |
| 5,094,040 | A | * | 3/1992 | Bunka | 52/14 |
| 5,099,622 | A | | 3/1992 | Sutton | |
| 5,467,564 | A | | 11/1995 | DeKeyser et al. | |
| 5,493,824 | A | | 2/1996 | Webster et al. | |
| 5,502,935 | A | * | 4/1996 | Demmer | 52/200 |
| 5,546,712 | A | | 8/1996 | Bixby | |
| 5,596,848 | A | | 1/1997 | Lynch | |
| 5,648,873 | A | | 7/1997 | Jaster et al. | |
| D382,347 | S | | 8/1997 | Grubb | |
| 5,655,339 | A | | 8/1997 | DeBlock et al. | |
| 5,878,539 | A | | 3/1999 | Grubb | |
| 5,896,712 | A | | 4/1999 | Chao | |
| 5,896,713 | A | * | 4/1999 | Chao et al. | 52/200 |
| 5,983,581 | A | | 11/1999 | DeBlock et al. | |
| RE36,496 | E | | 1/2000 | Sutton | |
| 6,035,593 | A | * | 3/2000 | Chao et al. | 52/200 |
| 6,219,977 | B1 | | 4/2001 | Chao et al. | |
| 6,256,947 | B1 | * | 7/2001 | Grubb | 52/200 |
| 6,321,493 | B1 | | 11/2001 | Rillie et al. | |
| 6,363,668 | B2 | | 4/2002 | Rillie et al. | |
| 6,412,238 | B2 | | 7/2002 | Rillie et al. | |
| 6,415,563 | B2 | | 7/2002 | Rillie et al. | |
| 6,438,803 | B2 | | 8/2002 | Rillie et al. | |
| 6,488,097 | B1 | * | 12/2002 | MacDonald et al. | 169/43 |

(Continued)

FOREIGN PATENT DOCUMENTS

| | | | |
|---|---|---|---|
| EP | 0313461 | A | 4/1989 |
| WO | WO 0225032 | | 3/2002 |

*Primary Examiner* — Ryan Kwiecinski
(74) *Attorney, Agent, or Firm* — Nexsen Pruet, LLC; Timothy D. St. Clair

(57) ABSTRACT

A skylight with displacement absorber and interlocking telescoping tubes is provided. The displacement absorber may be expandable, compressible, and bendable. The displacement absorber may absorb thermal expansion and contraction displacement between the skylight assembly relative to the building in which it is installed, as well as mechanical compression displacement from forces upon the building roof. The interlocking telescoping tubes may provide for telescopic adjustment of the length of the tube assembly. Also provided is a collar for securement to the building roof, the collar optionally including a condensation collection gutter. The skylight may also include a top elbow, adjustable for angular orientation of the light tubes depending from it. A lower adaptor box is also provided, for adapting from the cross-sectional geometry of the displacement absorber to desired cross-sectional geometries of interior ceiling diffusers.

4 Claims, 14 Drawing Sheets

(56) References Cited

U.S. PATENT DOCUMENTS

| | | | | |
|---|---|---|---|---|
| RE38,217 | E | 8/2003 | DeBlock et al. | |
| 6,871,459 | B2 * | 3/2005 | Van Dame | 52/200 |
| 6,907,938 | B2 * | 6/2005 | MacDonald et al. | 169/43 |
| 6,918,216 | B2 * | 7/2005 | Hoy et al. | 52/200 |
| 2001/0049916 | A1 | 12/2001 | Rillie et al. | |
| 2003/0066254 | A1 * | 4/2003 | DeBlock | 52/200 |
| 2004/0134140 | A1 * | 7/2004 | Gaddie et al. | 52/223.1 |
| 2005/0166490 | A1 * | 8/2005 | Darmer et al. | 52/200 |
| 2006/0150542 | A1 * | 7/2006 | Brinton et al. | 52/200 |
| 2011/0017880 | A1 * | 1/2011 | Osborn et al. | 248/74.1 |

* cited by examiner

SKYLIGHT WITH DISPLACEMENT ABSORBER AND INTERLOCKING TELESCOPING TUBES

BACKGROUND

The present invention relates generally to a tubular skylight assembly, and more particularly to a tubular skylight assembly with a displacement absorber and interlocking telescoping tubes.

Tubular skylights are used for transmission of outdoor, natural lighting to building interiors. Energy free and aesthetically pleasing, such devices enjoy great popularity. Tubular skylights are often installed in new construction, both residential and commercial, but also are installed as retrofitted improvements to existing residential and commercial structures.

A tubular skylight often includes an exterior dome upon the roof of a building, translucent or transparent. Light received by the dome is transmitted through light tubes to the interior of the building. The light tubes are disposed through the space between the exterior roof and the interior building ceiling. At the interior building ceiling, the transmitted light is passed through an interior light diffuser.

With more experience in the installation of tubular skylights, several problems have come to be identified. In no particular order of priority, a first problem arises from recognition that different dimensions exist in different buildings between the exterior roof and the interior ceiling, and that those dimensions may vary greatly. Moreover, even as to a particular structure, different dimensions exist between the roof and ceiling depending upon placement of the exterior dome upon the roof relative to placement of the diffuser on the interior ceiling. Economy in manufacture urges that standardization of the light tunnels would be desirable, yet a single length of light tunnel, or even a limited series of standardized lengths, cannot account for the virtually infinite variations encountered in the field. It would be desirable to have a skylight system with a light tunnel assembly that could be finely adjusted to meet the dimensions of any particular installation without requiring cutting of the light tunnel in the field or cumbersome manipulation of components. At the same time, it would be further desirable that any installation of such apparatus meeting the foregoing concerns also be as simple and foolproof as possible so as to prevent mis-assembly, mistakes, and so forth. Finally, any skylight system meeting all of the foregoing concerns also, desirably, should be inexpensive to manufacture, efficiently shippable, and easy to install.

Another problem is caused by the fact that buildings in which such tubular skylights are to be installed often have pitched roofs. While the pitch of building roofs usually is at one of only several standard gradients, the angle at which the light tunnels beneath such a roof must traverse to reach the interior diffuser panel can vary infinitely. While several devices that have already been commercialized purport to depict a straightforward and simple alignment between the exterior dome and the interior diffuser panel, experience in the field teaches that precise measurement, good alignment, and efficient light transmission can be difficult to achieve with such devices. It would be desirable, therefore, to have a skylight assembly that would allow simple yet effective fine tuning in the field of the angular orientation of the light tunnel.

Still further, it has come to be recognized that some tradesmen installing tubular skylights often prefer to assemble and install as much of a skylight system as possible from the building roof, and concomitantly to minimize the amount of time and assembly required from indoors. Reasons for this preference are varying, but include concern that indoor work in retrofitting efforts to existing buildings is intrusive to building occupants, may be crowded with other tradesmen engaged in other tasks in new construction installations, risks collateral damage from tools, ladders, and the like to interior, fine-finished surfaces such as floors and walls, and so forth. Because those who install tubular skylights often view as better devices that can be more completely assembled and installed from the outside, it would be desirable to have a skylight system that allows for the assembly and installation of as much of a skylight system as possible from the exterior building roof.

A fourth problem has been discovered with specific reference to installation of tubular skylights in new construction. Particularly, it is often desirable to be able to install a tubular skylight before the finished interior ceiling is installed. Such a desire might stem from the increased latitude provided with the scheduling and coordination of the various tradesmen involved in new construction. Moreover, installation of the skylight assembly before installation of the finished ceiling allows for more ready and efficient inspection by governmental authorities monitoring code compliance. Some attention to this concern is noted in U.S. Pat. No. 5,896,713, which contemplates attachment of a support ring to a ceiling joist prior to installation of ceiling drywall. However, the device in the '713 patent requires, at a minimum, installation of the tubular skylight after installation of the ceiling joist, and makes no allowance for installations in buildings having no ceiling joists. It would be more desirable, therefore, to have a tubular skylight assembly that could be installed after construction only of the building roof and before construction or installation of any ceiling structure or components. Such would be desirable, for example, as to installation in which ceiling joists are not ever to be installed, for example with the use of suspended tile ceilings.

Three other problems have been identified with reference to existing tubular skylight systems, and these three problems do not relate to the method or timing of installation but instead to the function and continued integrity of the skylight after installation. First, governmental authorities in some jurisdictions have enacted building code requirements that require devices such as tubular skylights to withstand certain earthquake forces. For example, one such requirement for a tubular skylight for use with the suspended ceiling requires that the tubular skylight assembly remain affixed to the roof structure of a building even if the suspended ceiling collapses as a result of earthquake forces. Skylight assemblies in which the light tubes or other components are supported by the ceiling cannot satisfactorily meet such requirements. It would be desirable to have a skylight assembly the components of which are carried by the roof of the building rather than by the ceiling.

A second functional problem has been discovered with regard to thermal expansion and contraction of the skylight assembly and/or the building in which the assembly is installed. Various components of the building and/or the skylight assembly may expand or contract thermally at different rates. Moreover, mechanical compression of an installed skylight assembly may result from workers upon the roof of a building, the weight of whom may tend to deflect the roof downward. Both the structural integrity and the aesthetic appeal of the skylight system should be preserved in either event. Thermal expansion of the skylight assembly, or compression of the roof sheathing by workers upon the roof, might cause the diffuser panel at the interior ceiling to protrude from the plane in the ceiling, or may break loose attached components of the skylight assembly, either result being undesirable. Alternatively, either effect may cause the structure of the exterior dome to protrude upward from its installed position upon the roof, breaking loose weatherproofing that would otherwise seal the installed assembly. It would be desirable, therefore, to have a skylight assembly that absorbs thermal expansion and contraction, and mechanical compression, while preserving weatherproofing, structural integrity, and aesthetic appeal of the assembly.

Finally, another problem has been encountered with the use of tubular skylights in applications in which a rectangular diffuser panel is used at the interior ceiling, such as with a suspended ceiling. It is known that light tubes of generally circular cross-section are most efficient in transmitting light from the exterior dome to the interior diffuser panel. However, adapting from such a generally circular cross-sectional light tunnel to a rectangular diffuser panel has been found to cause differential lighting upon the diffuser panel. Sometimes known as "hot spots," in such applications the diffuser panel tends to have regions of greater light intensity and regions of lesser light intensity, a phenomenon considered to be undesirable by the consuming public. Rather, it would be desirable in such applications to provide an adaptor member between the generally circular cross-sectional light tunnel and the rectangular diffuser panel that provides a more pleasing and even distribution of light upon the diffuser panel.

The present invention relates to a new skylight assembly that provides distinct advantages of the conventional systems and methods.

SUMMARY OF THE INVENTION

In response to the described problems and difficulties encountered before, a new skylight with a displacement absorber and interlocking telescoping tubes has been discovered.

According to the present invention, a tubular skylight assembly for use in a building having a roof and a ceiling is provided. The assembly includes a mounting collar and an exterior dome is attached to the mounting collar. A light transmitting top elbow depends from the collar inwardly through the roof of the building. Attached below the top elbow may be first and second light tubes that telescope between each other. Attached to the bottom of the light tubes may be a displacement absorption member. A displacement absorber likewise is a light tunnel, but is compressible and flexible, and may be bent at an angle different from the axis of the light tunnel(s). At the lower end of the displacement absorber may be an adaptor box. Circular at its top and rectangular at its bottom, the adaptor box efficiently and effectively transmits the light received from the tunnel assembly and flexible displacement absorber to an interior diffuser at the interior ceiling.

Accordingly, there is provided in the present skylight assembly a collar. The collar may include a condensation collection gutter, as well as drain holes from the gutter to the exterior of the skylight assembly. The exterior dome of the skylight assembly may be attached to the collar, either by snap fit or by mechanical fasteners. The collar generally would be positioned exterior to the building, upon the building roof, and flashing between the collar and the roof weatherproofs the skylight assembly with respect to the building. Alternatively, the collar itself as a single unit may provide for flashing of the installation.

A rigid top elbow is likewise provided. The top elbow is carried by the collar, and depends downwardly from the collar through the roof into the building interior. The top elbow may include an upper section and a lower section, with the upper and lower sections rotatable relative to each other at an angular junction between them. The top elbow also may include limiting means for limiting the top elbow from further downward movement relative to the collar once the top elbow has been assembled properly to a predetermined position in the collar. Likewise, the top elbow may include means for preventing upward movement of the top elbow relative to the collar once the top elbow has been properly assembled to such predetermined position within the collar.

Light tubes are carried by the top elbow, and depend downwardly from it further into the interior of the building. One or more light tubes, including first and second light tubes, may be used. The first and second light tubes are telescopically connected, such that one telescopes within the other to form an assembly. One or more such light tube assemblies, each such assembly including telescopically connected first and second light tubes, may be connected in series, as dimensionally required in installations of particular dimensions. Of the two light tubes, the one of larger diameter includes a female interlock feature, and the one of smaller diameter includes a male interlock feature adapted to abut the female interlock feature. The male and female interlock features are disposed proximate to ends of the respective light tubes, such that the two interlock features will abut as the two light tubes approach their greatest length of telescopic extension. Optionally, two male interlocks may be provided proximate to the opposing ends of the light tube of smaller diameter, to prevent disconnection of the telescopic assembly. Once installed in a particular building, and extended suitably for effective interconnection of the various skylight assembly components, the two light tubes are screwed, riveted, or otherwise fastened together.

A displacement absorber is carried by the lower end of the telescoping light tube combination. The displacement absorber transmits light through its interior aperture, but is capable of compression to smaller dimensions or extension to larger dimensions depending upon thermal contraction or expansion forces upon the skylight assembly or mechanical compression of the skylight assembly resulting upon weight upon the roof of the building. Further, the displacement absorber may be bendable relative to the axis of the first and second light tubes, so that the path of light provided by the exterior dome, top elbow, and light tubes may be bent to another direction for orientation into the interior of the building.

Beneath and attached to the displacement absorber is an adaptor box. The adaptor box has an upper opening and an opposed lower opening. The upper opening is configured for attachment to the end of the displacement absorber. The lower opening of the adaptor box may be of any geometry, including a rectangular geometry fitting into standardized suspended ceiling grids.

The skylight assembly also includes secondary means for securing the assembly to the roof of the building, to provide, for example, earthquake resistance of the structure. Such means include cabling or strapping extending from roof structures to the lower aspect of the lower of the two light tubes, and also may include further securement to the lower adaptor box.

So configured, it is an object of the present invention to provide a new skylight assembly that has all of the advantages of the prior art and none of the disadvantages.

It is another object of the present invention to provide a new skylight assembly that may be easily and efficiently manufactured and distributed.

It is a further object of the present invention to provide a new skylight assembly that is of durable and reliable construction.

It is a further object of the present invention to provide a new skylight assembly that is easy to install.

It is a further object of the present invention to provide a new assembly that may be substantially assembled and installed from the exterior of the building.

Additional objects and advantages of the invention will be set forth in the following description or may be obvious from the description. Structural and operational details of preferred designs of the present invention and components embodying the invention and advantages obtained thereby will become apparent from the appended drawings and the detailed description to follow.

BRIEF DESCRIPTION OF THE DRAWINGS

The details of the present invention, both as to its structure and as to its operation, can be understood in reference to the accompanying drawings, in which like reference numbers refer to like parts. It should be noted that the drawings may not be to scale in all instances, but instead may have exaggerated dimensions in some respects to illustrate the principles of the invention.

DETAILED DESCRIPTION

Figure 1:
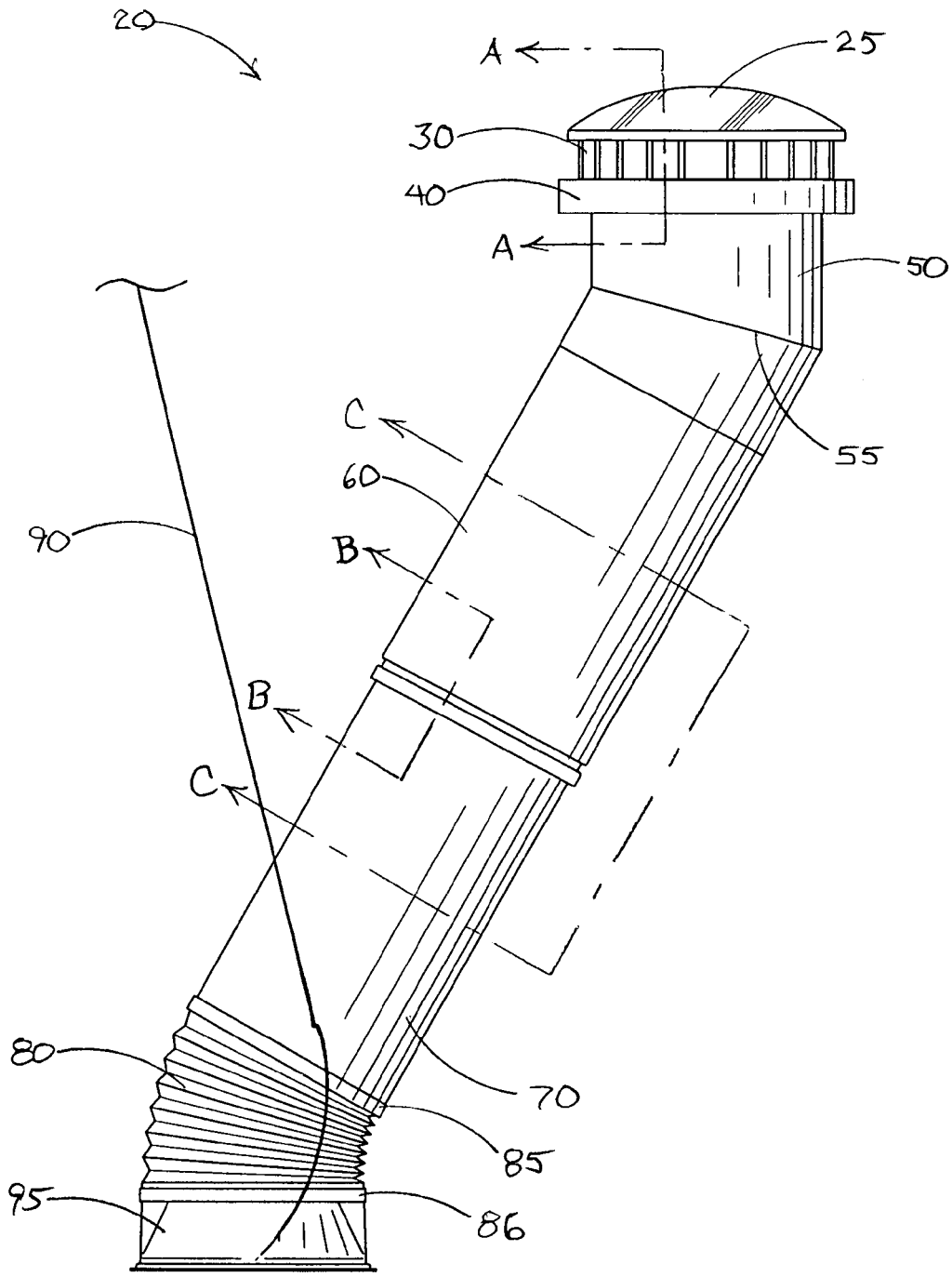
FIG. 1 is a side view of a skylight assembly in accordance with one exemplary embodiment of the present invention.

A full and enabling disclosure of the present invention, including the best mode contemplated by the inventors of carrying out their invention, is set forth herein. Reference will be made in detail to the presently preferred embodiments of the invention, one or more examples of which are illustrated in the drawings. Each example is provided by way of explanation of the invention, and is not meant as a limitation of the invention. For example, features illustrated or described as part of one embodiment may be used in another embodiment to yield a still further embodiment. It is intended that the present application include such modifications and variations as come within the scope and spirit of the invention. Repeat use of reference characters throughout the present specification and appended drawings is intended to represent the same or analogous features, elements, or components.

According to the present invention and with reference to FIG. 1, a tubular skylight assembly, generally 20, is provided for use in a building having a roof and a ceiling. This assembly provides a collar 30, to which is mounted an exterior dome 25. A light transmitting top elbow 50 depends through the collar 40 inwardly for disposition through the roof of the building. Attached to top elbow 50 is a light tube 60; attached to light tube 60 is a second light tube 70. Light tubes 60 and 70 are in telescopic engagement between each other. Depending beneath light tube 70 is a displacement absorber 80, from which in turn depends a lower adaptor box 95 adapted for installation in an interior ceiling of a building. The top elbow 50, light tubes 60 and 70, displacement absorber 80, and lower adaptor box 95 may have reflective inner surfaces, for reflection of light transmitted therethrough.

As depicted in FIG. 1, the skylight assembly may be understood to have a generally vertical orientation, with "upper" and "top" understood to refer toward the exterior roof of a building, upon which, for example, exterior dome 25 may be found, and with "lower" and "bottom" referring to an orientation toward the interior ceiling of the building, to which lower adaptor box 95 may be disposed.

Figure 2:
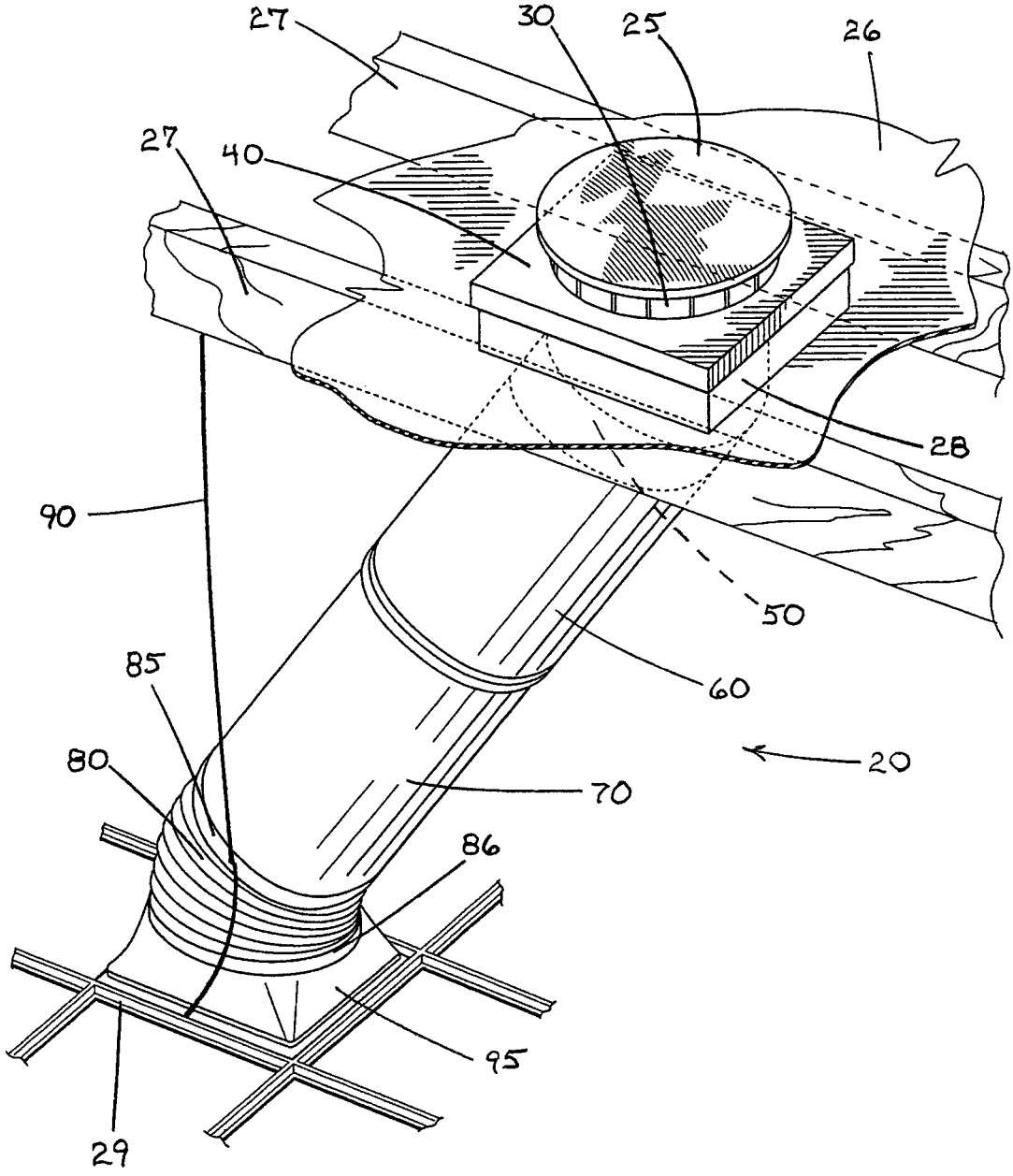
FIG. 2 is an isometric view of a skylight assembly in accordance with one exemplary embodiment of the present invention, as installed in a building with roof sheathing, roof rafters, and an underlying suspended ceiling grid.

In FIG. 2, skylight assembly 20 is illustrated as installed in a building. Such installation may include a roof composed of roofing trusses 27, upon which is mounted roof sheathing 26. Through a hole cut through sheathing 26, skylight assembly 20 may be installed. Support of skylight assembly 20 upon the roof, as well as exterior weatherproofing, may be accomplished through use of flashing 40 or the like. In one embodiment, flashing 40 is configured of 20 gauge steel, painted for corrosion resistance. Installation may be accomplished with or without use of an exterior curb 28. Flashing 40 will be adapted for effective sealing between curb 28 and collar 30 in installations in which an exterior curb 28 is constructed. Alternatively, flashing 40 will be adapted for effective sealing with other roofing elements such as asphalt shingles, polymer membranes, and the like (not shown) in installations in which no exterior curb is used (not shown). In a still further embodiment (not shown), collar 30 and flashing 40 may be a single unit, collar 30 thereby supporting skylight assembly 20 upon the roof and providing weatherproofing between the skylight assembly 20 and the roof, obviating any need for flashing 40.

As will be explained in more detail below, cabling 90 may be used for secondary securement of skylight assembly 20 within a building, for example for compliance with earthquake resistance building code specifications.

Figure 3:
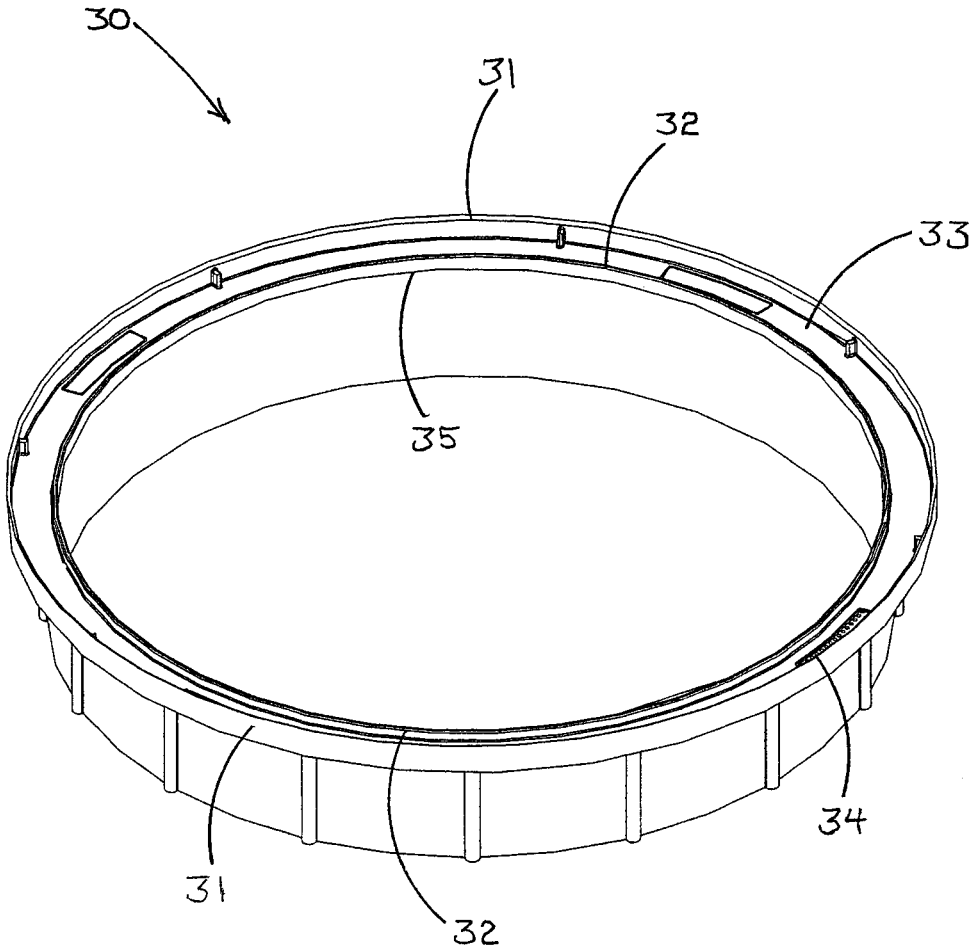
FIG. 3 is an isometric view of one embodiment of a collar of a skylight assembly in accordance with the present invention.

Turning in detail to the components of skylight assembly 20, FIG. 3 illustrates collar 30. In one embodiment, depicted in FIG. 3, collar 30 is provided with an outer lip 31. Exterior dome 25 fits over column 30, particularly over outer lip 31. Accordingly, any rainfall upon exterior dome 25 would be shed from exterior dome 25 to the exterior of collar 30. Collar 30 may also include inner lip 32, disposed radially inwardly from outer lip 31. Also with illustrative reference to FIGS. 4A and 4B, it will be seen that outer lip 31 and inner lip 32 cooperate to form gutter 33 between them. Gutter 33 is disposed for collection of condensation that may form upon the interior of exterior dome 25 within the interior space of skylight assembly 20. Collar 30 may also include drain holes 34 within gutter 33 (FIG. 3), for efficient draining of condensation from the interior of dome 25 and gutter 33 to the exterior building roofing system. It will be observed from FIGS. 3, 4A, and 4B, that collar 30 also includes a ledge 35 about its interior. As will be described in more detail below, ledge 35 is configured for engagement with certain features of top elbow 50. As illustratively depicted in FIG. 3, collar 30 is of generally round cross-sectional geometry. However, collar 30 may be of any particular cross-sectional geometry, with the cross-sectional geometry of outer lip 31 adapted for receipt of any particular geometry or shape of exterior dome 25. Likewise, the interior passage of collar 30 is depicted in FIG. 3 as being round, as would be required for engagement with a tubular skylight of round cross-sectional geometry, but if other cross-sectional geometries of skylight tubes are used, the interior passage of collar 30 likewise may be adapted to other complementary cross-sectional geometries. Collar 30 may be constructed of steel, plastics, resins, polymers, copper, tin, or aluminum, as suited in particular applications.

Figure 4A:
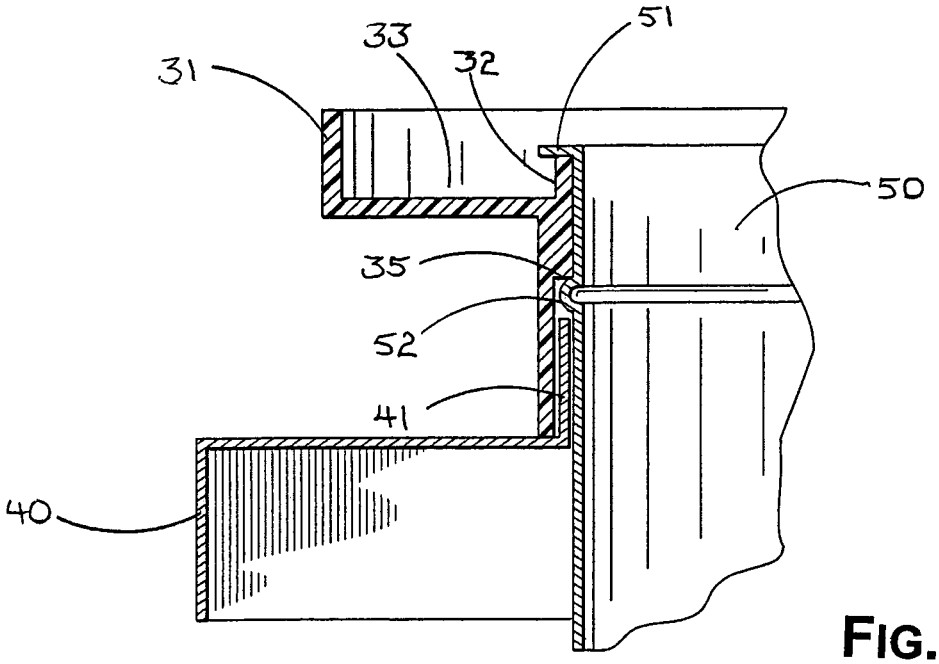
FIG. 4A is a partial cross-sectional view of one embodiment of one aspect of a skylight assembly, taken along line A-A in FIG. 1.
Figure 4B:
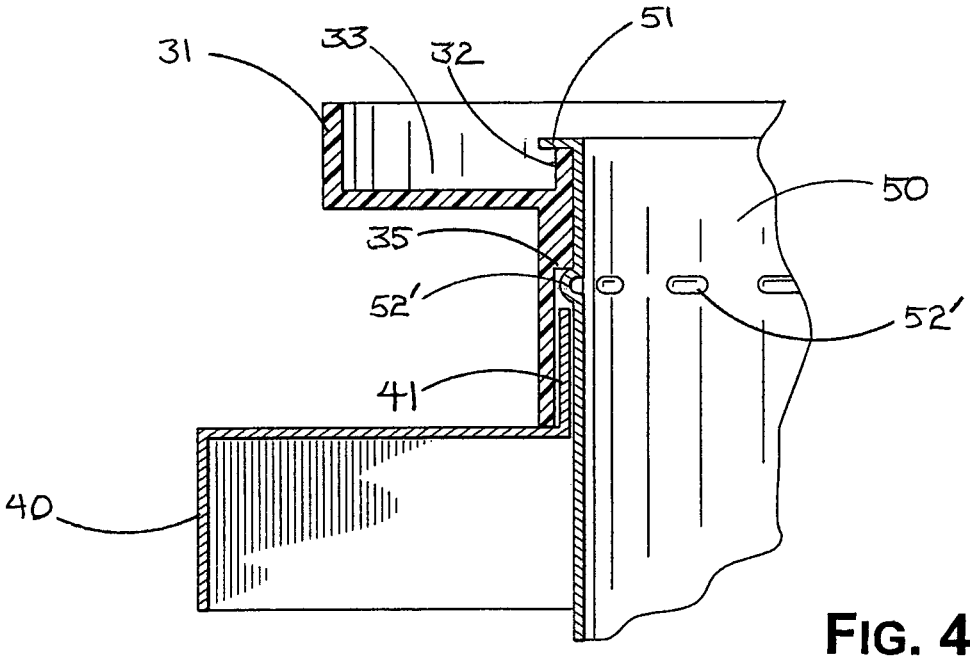
FIG. 4B is a cross-sectional view of another embodiment of one aspect of a skylight assembly in accordance with the present invention, as would be taken along line A-A in FIG. 1.

As illustrated in FIG. 1, top elbow 50 depends from collar 30. Top elbow 50 may be adapted for engagement with collar 30, as will now be explained with reference to FIGS. 4A, 4B, 5A, and 5B. Top elbow 50 may be constructed with limiting means for limiting top elbow 50 from downward movement relative to collar 30 upon attachment of top elbow 50 to collar 30. One embodiment of such limiting means is depicted in FIGS. 4A, 4B, 5A, and 5B, as upper flange 51. As depicted in FIGS. 4A and 4B, upper flange 51 is adapted for abutment with inner lip 32 of collar 30. Once top elbow 50 is properly in place within collar 30, as depicted in FIGS. 4A and 4B, upper flange 51 of top elbow 50 abuts the top of inner lip 32, limiting top elbow 50 from further downward movement relative to collar 30. Alternative means of such limitation include an outer band attached to the upper end of top elbow 50 (not shown) for abutment against inner lip 32; screws, bolts, and the like through the sidewalls of the upper end of top elbow 50 (not shown) for abutment against inner lip 32; or a U-shaped formation to the top of top elbow 50 (not shown) for engagement around inner lip 32 into gutter 33.

Figure 5A:
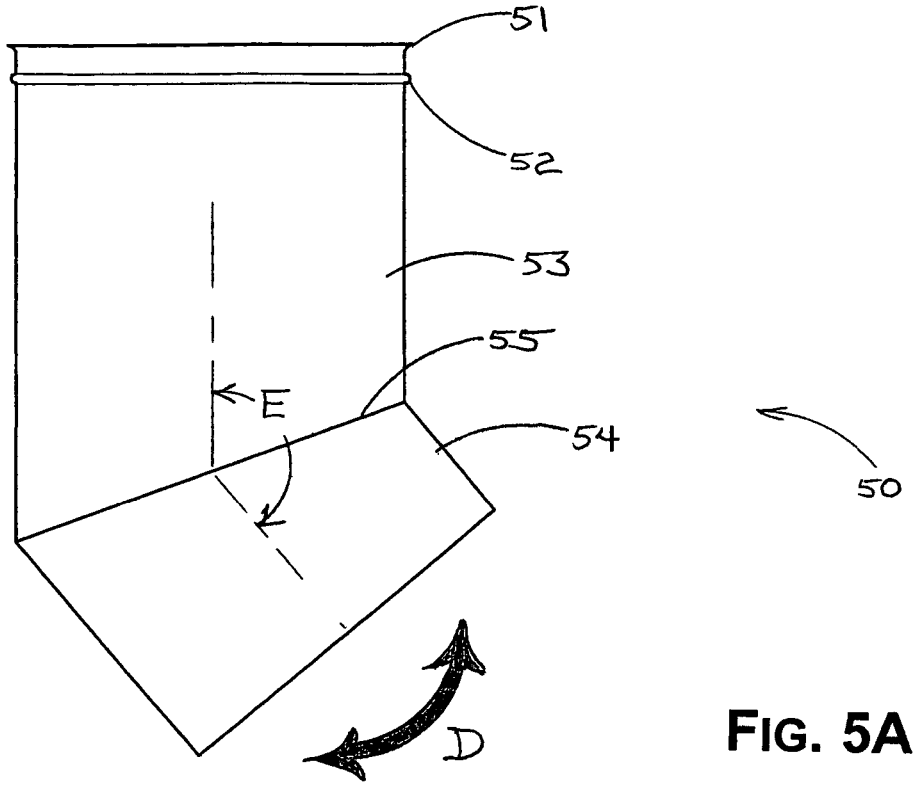
FIG. 5A is a side view of one embodiment of a top elbow of a skylight assembly in accordance with the present invention, with its component tubes rotated to provide obtuse angular engagement between them.
Figure 5B:
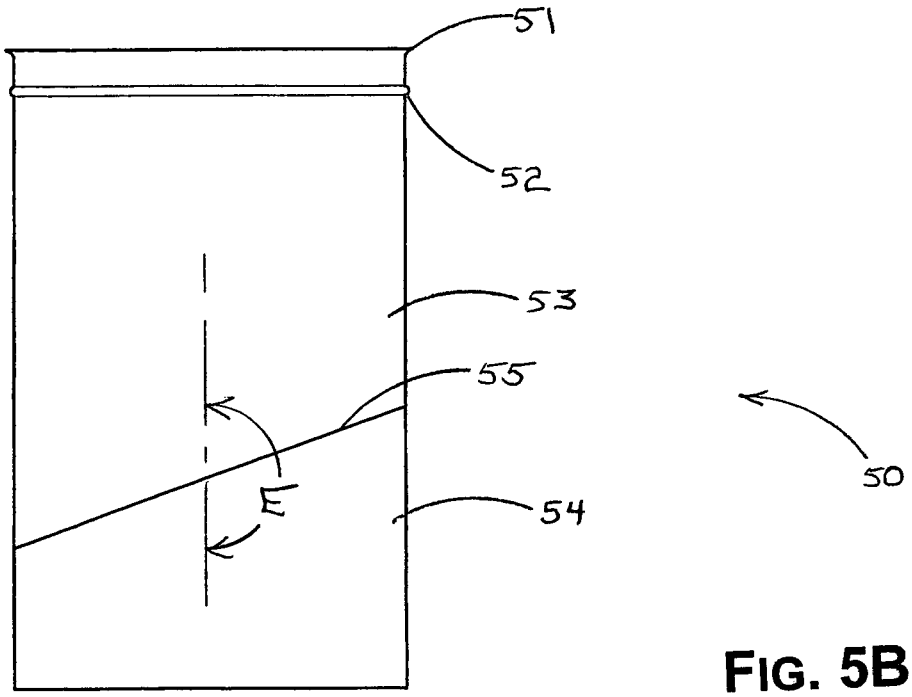
FIG. 5B is a further side view of one embodiment of a top elbow of a skylight assembly in accordance with the present invention, with its component tubes rotated to provide alignment of the axes of the component tubes.

Top elbow 50 may also be configured to include means for preventing upward movement of top elbow 50 relative to collar 30 upon assembly of top elbow 50 within collar 30. One exemplary embodiment of such means is depicted in FIGS. 4A, 4B, 5A, and 5B, as shoulder 52. Shoulder 52 may be formed in several ways. As depicted in FIGS. 4A, 5A, and 5B, shoulder 52 may be a rolled ridge about the circumference of top elbow 50, disposed proximate to the upper end of collar 50. Alternatively, and as depicted in FIG. 4B, shoulder 52 may instead be constructed of a series of dimples 52' from the interior of top elbow 50. As dimples 52' from the interior of top elbow 50, protrusions are formed outwardly from the exterior of top elbow 50, as depicted in FIG. 4B. Shoulder 52 or dimples 52', as the case may be, are disposed at a predetermined distance from upper flange 51 so as to engage collar 30 at ledge 35. As depicted in FIGS. 4A and 4B, with top elbow 50 properly installed within collar 30, and with upper flange 51 of top elbow 50 abutting inner lip 32 of collar 30, shoulder 52/dimples 52' engage ledge 35 to prevent upward movement of top elbow 50 relative to collar 30.

As will be observed from FIGS. 4A and 4B, collar 30 is also configured for receipt of annulus 41 of flashing 40. As illustrated, annulus 41 is disposed inboard of collar 30, annular about top elbow 50. In one embodiment, silicone may be used between collar 30 and annulus 41 for further enhanced weatherproofing.

FIGS. 5A and 5B illustrate a still further aspect of top elbow 50 in one embodiment of skylight assembly 20. As depicted, top elbow 50 may be constructed of upper section 53 and lower section 54. Upper section 53 and lower section 54 may be joined in manners known in the art at joint 55 to allow rotation in directions as indicated by double-headed arrow D between upper section 53 and lower section 54. Joint 55 may be constructed at an angle relative to the axes of upper section 53 and lower section 54, such that rotation of upper section 53 relative to lower section 54 creates varying angular orientation E between such respective axes. As such, top elbow 50 may be configured, by relative rotation of its upper section 53 and lower section 54, to provide for an infinite range of angles E between such axes. One such angle E that may be realized is 180°, as the axes of upper section 53 and lower section 54 are aligned, as depicted in FIG. 5B, an alignment useful for installation of top elbow 50 into collar 30 and installation of flashing 40 on top elbow 50, as described below. Upper section 53 may be constructed of a length sufficient to depend from collar 30 and flashing 40 past underlying roof rafters 27 to allow complete ranges of angular orientation E between upper section 53 and lower section 54, as well as to allow complete rotation of top elbow 50 within collar 30 without interference with roof rafters 27.

FIG. 1 also illustrates light tube 60 as depending from top elbow 50, and light tube 70 depending in turn from light tube 60. Light tube 60 may be fastened to the bottom of top elbow 50 by screws, rivets, brads, and the like.

Light tube 60 and light tube 70 are attached together in telescopic engagement. As illustrated in FIG. 1, light tube 70 telescopes within light tube 60, but such is for illustration purposes only. Alternatively, the inward telescoping light tube may be configured above the outward telescoping light tube in alternative embodiments.

Figure 6A:
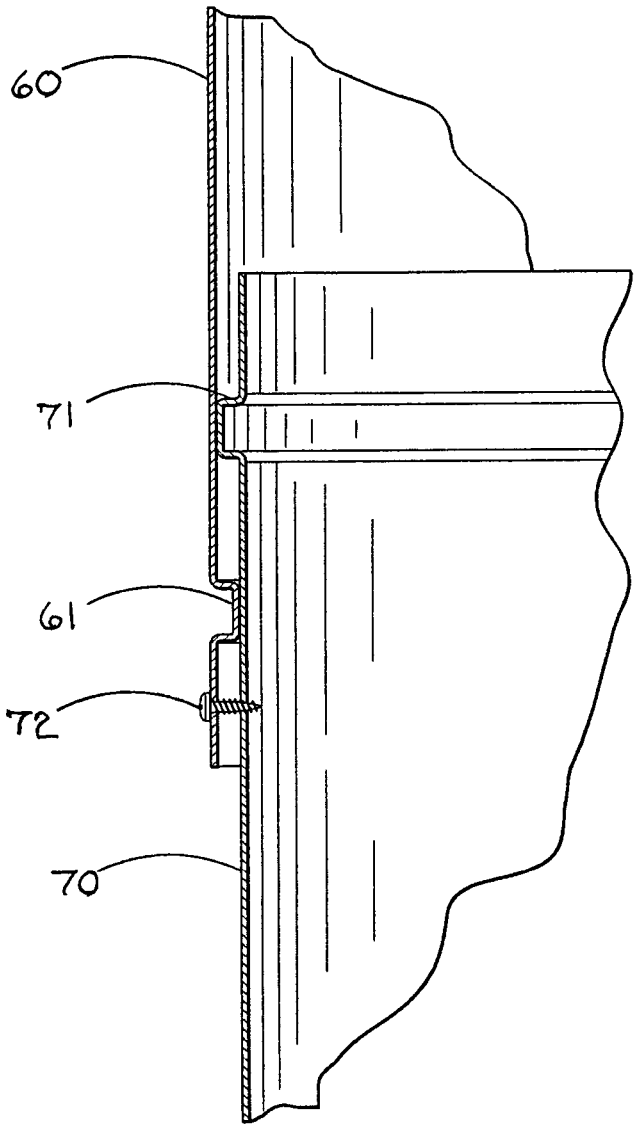
FIG. 6A is a cross-sectional view of one embodiment of a portion of the present invention, taken along lines B-B in FIG. 1.

Light tubes 60, 70 include interlock features that define a stop position of the telescopic movement between the two light tubes. One embodiment of such interlock features is illustrated in FIG. 6A. As shown in FIG. 6A, outer light tube 60 may include a female interlock 61 disposed proximate to one end thereof. Female interlock 61 may be formed by rolling of the material of light tube 60, to produce a feature of decreased internal diameter, relative to light tube 60. In turn, light tube 70 may include a male interlock 71, likewise disposed proximate to one end thereof. Male interlock 71 depicted in FIG. 6A may similarly be formed by rolling a feature of increased diameter, relative to the diameter of light tube 70. So configured, the female interlock 61 of light tube 60 and the male interlock 71 of light tube 70 may engage each other as light tubes 60, 70 slide in telescopic engagement. Once interlocks 61, 71 engage, a stop position is realized beyond which further telescopic movement is prevented.

Figure 6B:
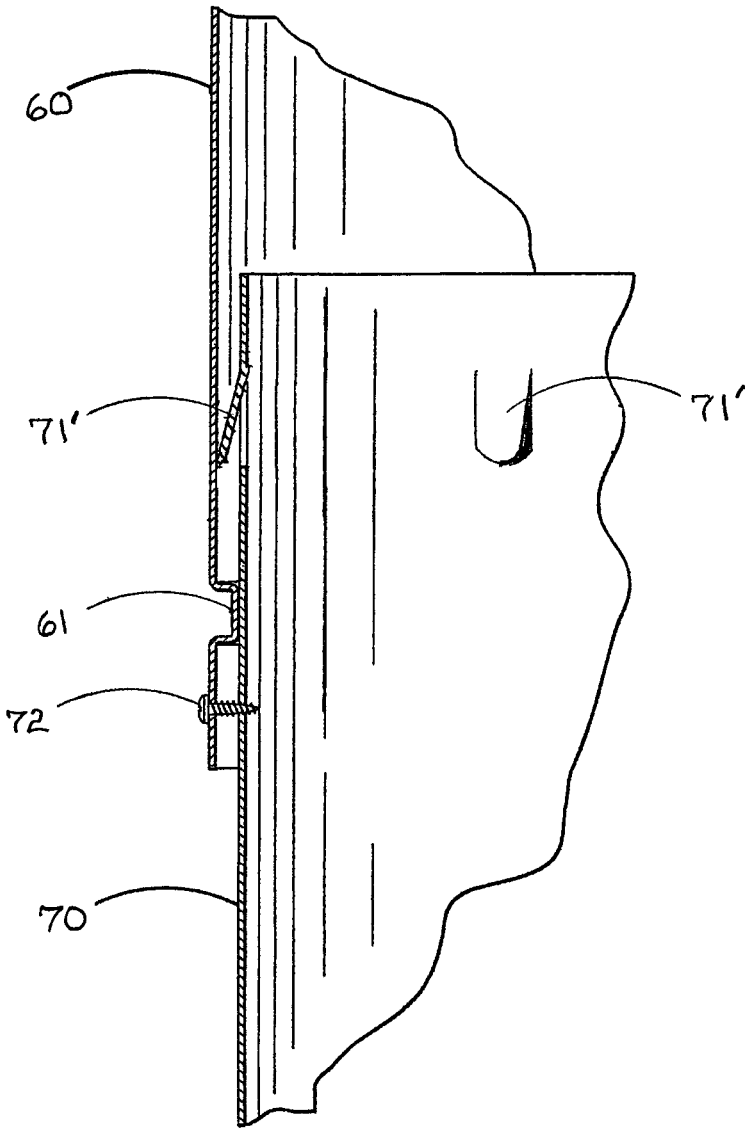
FIG. 6B is a cross-sectional view of an alternative embodiment of a portion of a skylight in accordance with the present invention; taken along line B-B in FIG. 1.

Interlocks 61, 71 as depicted in FIG. 6A are provided for illustration purposes only. Other embodiments of interlocks may be included. For example, male interlock 71' depicted in FIG. 6B may be formed by the cutting or stamping of a plurality of three sided ears or tabs into light tube 70 and forming such ears to bend slightly outward from the cylinder of light tube 70. So configured, and understanding that light tube 70 and consequently interlock 71' are of steel, aluminum, tin, plastic, or other resilient material, it will be appreciated that light tube 70 may be installed within light tube 60 by sliding light tube 70 past female interlock 61 causing interlocks 71' to temporarily depress, allowing their passage past female interlock 61. One such passage is accomplished, interlocks 71' will spring back into their outwardly extending position. Thereupon, attempts to remove light tube 70 from light tube 60 would be prevented in the direction of female interlock 61 by the abutment of interlocks 71' against female interlock 61.

Light tubes 60 and 70 may be assembled in telescopic engagement by inserting the end of light tube 70 opposite male interlock 71, 71' into the end of light tube 60 opposite female interlock 61. Such assembly may be understood with reference to FIG. 6C, in which light tube 70 has been installed downward through the top of light tube 60. Also as to be appreciated from FIG. 6C, light tubes 60 and 70 may move relative to each other in directions indicated by double-headed arrow F unless affixed together. Such fixing may be accomplished with use of screws 72 (FIGS. 6A, 6B), which will be explained in more detail below.

Figure 6C:
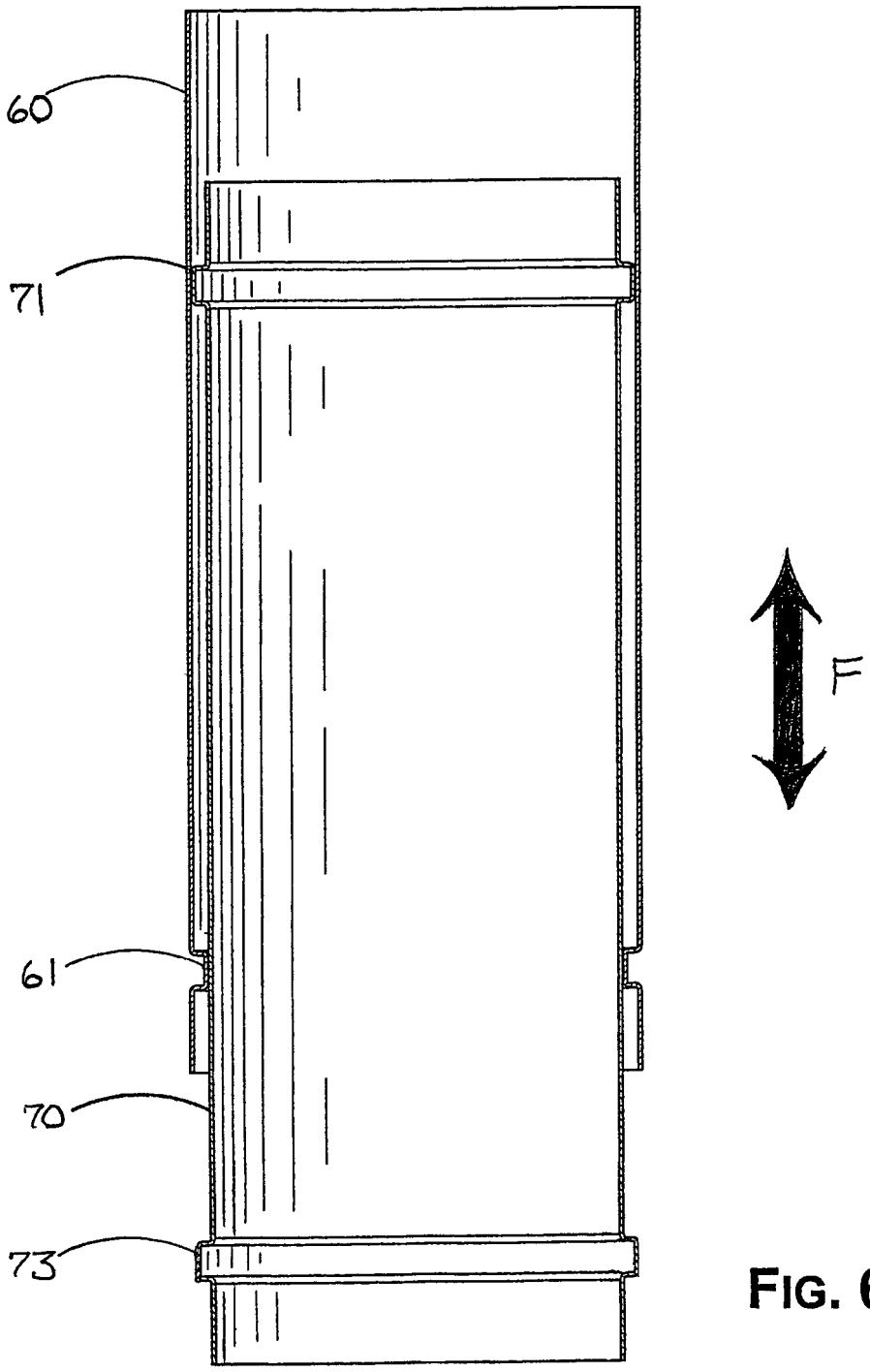
FIG. 6C is a cross-sectional view taken along line C-C in FIG. 1.

As shown in FIG. 6C, second light tube 70 may also optionally include a second interlock 73, disposed upon light tube 70 opposite interlock 71, preventing the removal of second light tube 70 from first light tube 60. Second interlock 73 may be a male interlock of increased diameter, relative to the diameter of light tube 70. Alternatively, second interlock 73 may be an ear or tab as male interlock 71' previously described, oppositely oriented from male interlock 71' depicted in FIG. 6B to likewise be abuttable against female interlock 61 of light tube 60, second interlock 73 formed by the cutting or stamping of a plurality of three sided ears or tabs into light tube 70 and bending such ears slightly outward from the cylinder of light tube 70. Second interlock 73 may be created by first constructing light tubes 60, 70, with interlocks 61, 71 respectively, then inserting the end of light tube 70 opposite male interlock 71, 71' into the end of light tube 60 opposite female interlock 61. Thereafter, second interlock 73 may be formed into light tube 70.

Figure 7A:
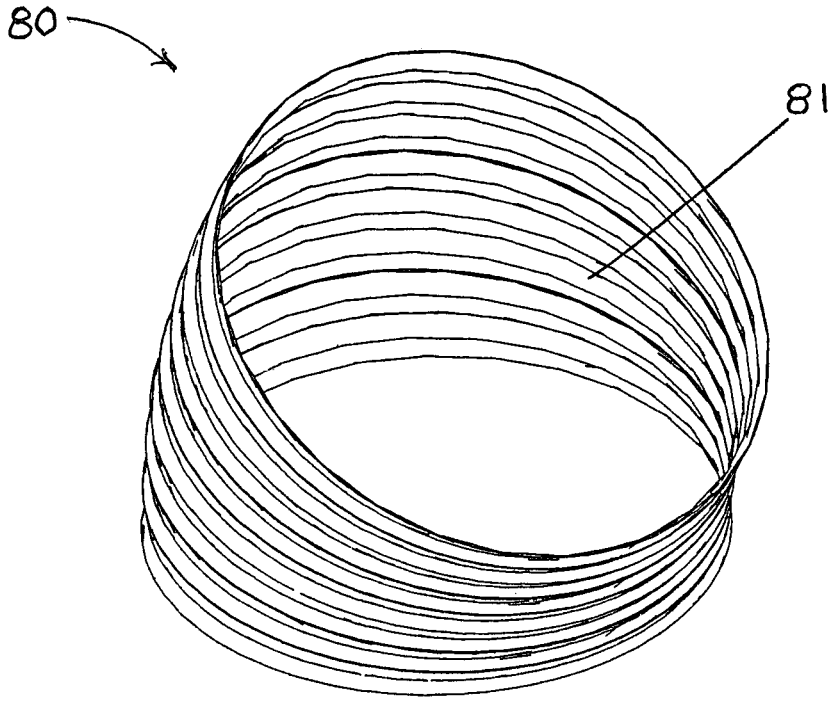
FIG. 7A is an isometric view of one embodiment of a displacement absorber of a skylight assembly in accordance with the present invention.
Figure 7B:
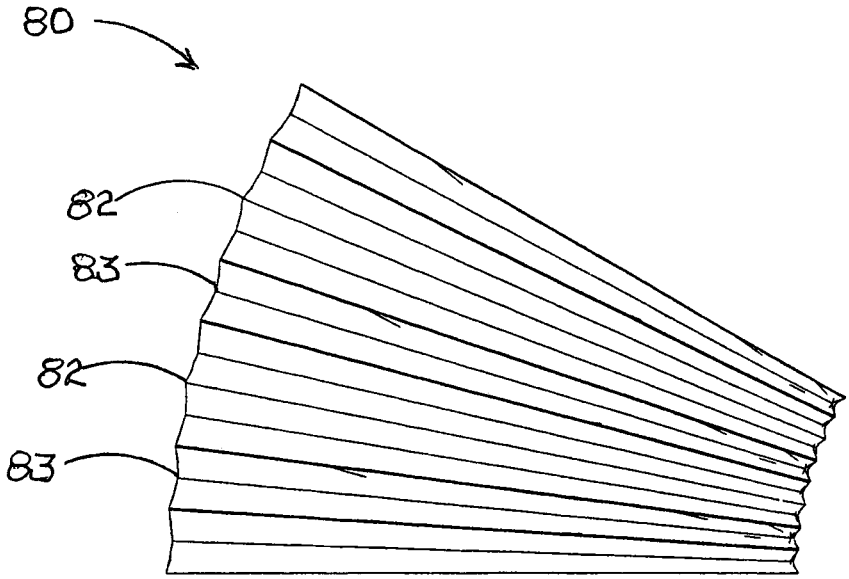
FIG. 7B is a side view of one embodiment of a displacement absorber of a skylight assembly in accordance with the present invention.
Figure 7C:
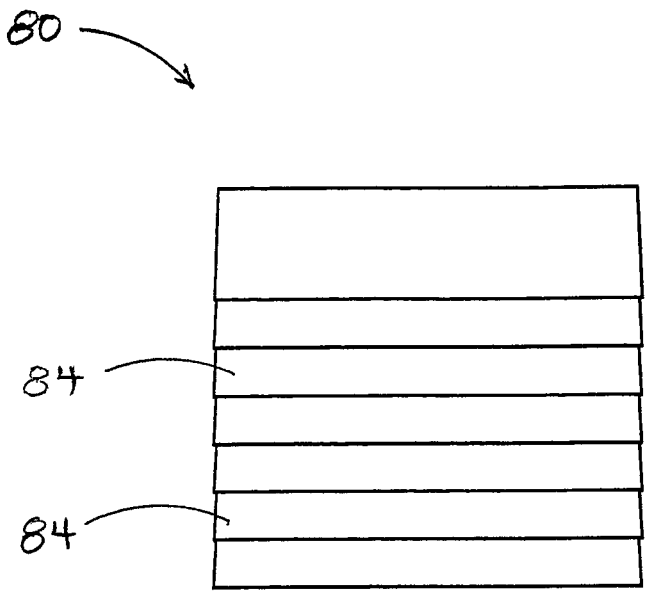
FIG. 7C is a side view of a second exemplary embodiment of a displacement absorber, illustrated in unbended configuration, of a skylight assembly in accordance with the present invention.
Figure 7D:
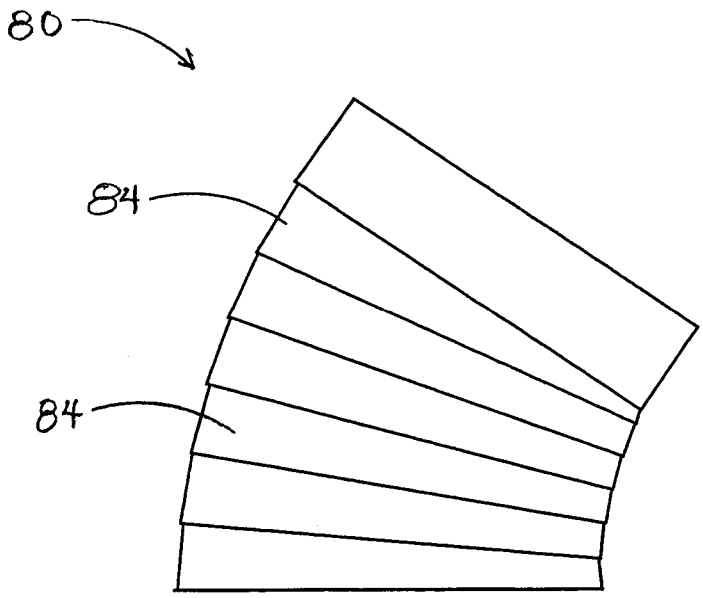
FIG. 7D is a second side view of the displacement absorber of FIG. 7C, shown in partially compressed and bended configuration.

A displacement absorber 80, illustrated in FIGS. 7A, 7B, 7C, and 7D is carried by the lower end of the lower of light tubes 60, 70 as illustrated in FIG. 1. While inner surface 81 of displacement absorber 80 preferably is highly reflective, so as to transmit light received from light tubes 60, 70, displacement absorber 80 may shorten or lengthen, in compression or tension respectively, because of its flexible nature. Likewise, displacement absorber 80 is bendable relative to the axes of light tubes 60, 70 as depicted for example in FIG. 1. Displacement absorber 80 may be constructed of a flexible substrate as an accordion bellows, with alternating male folds 82 and female folds 83 (FIGS. 7A, 7B). Displacement absorber 80 may be constructed of a thread reinforced polyester fabric upon a spiral wound spring wire. Still alternatively, as illustrated in FIGS. 7C and 7D, displacement absorber 80 may be constructed of independent rigid rings 84 united for overlapping relative movement between them. Displacement absorber 80 may be attached to directly to light tube 70, or with upper band 85 shown in FIG. 1. Upper band 85 may be used as a mounting platform for screws through both displacement absorber 80 and light tube 70, to avoid tearing by the screws of the material of displacement absorber 80.

Figure 8A:
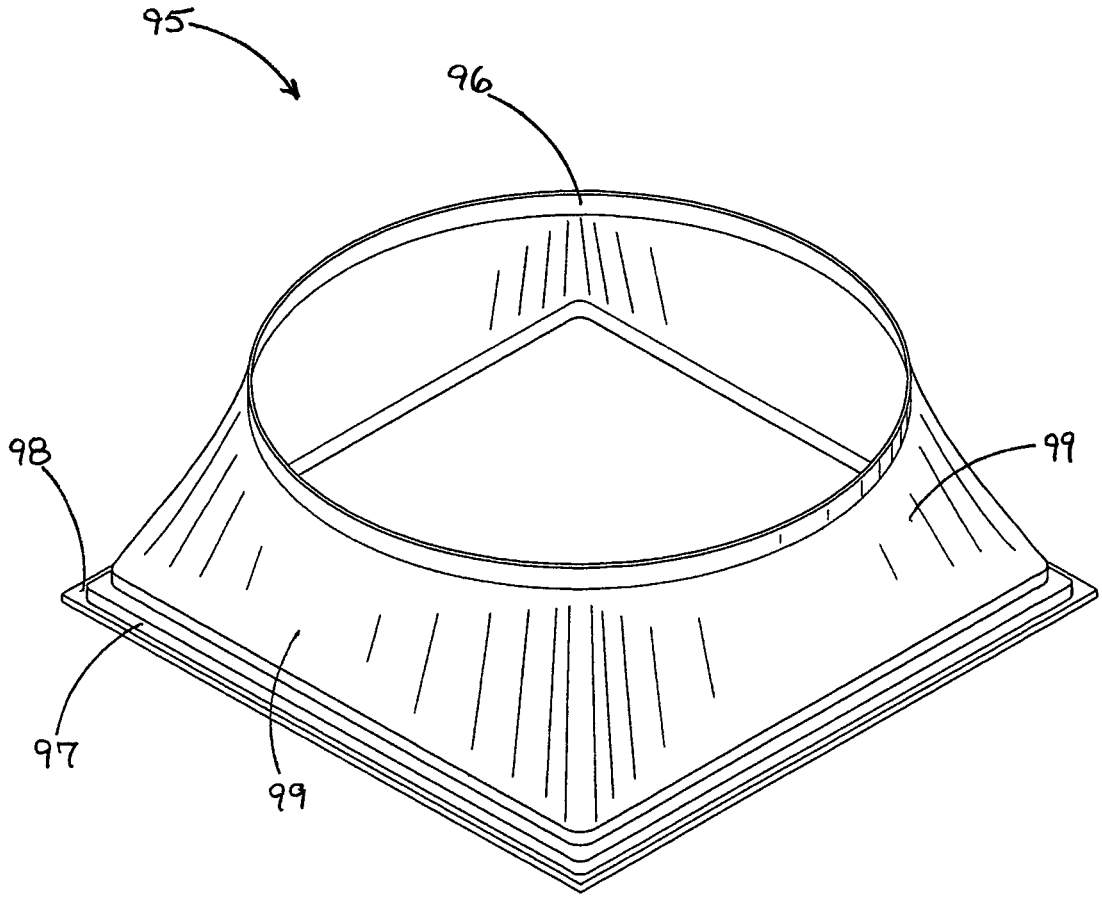
FIG. 8A is an isometric view of one embodiment of a lower adaptor box of a skylight assembly in accordance with the present invention.
Figure 8B:
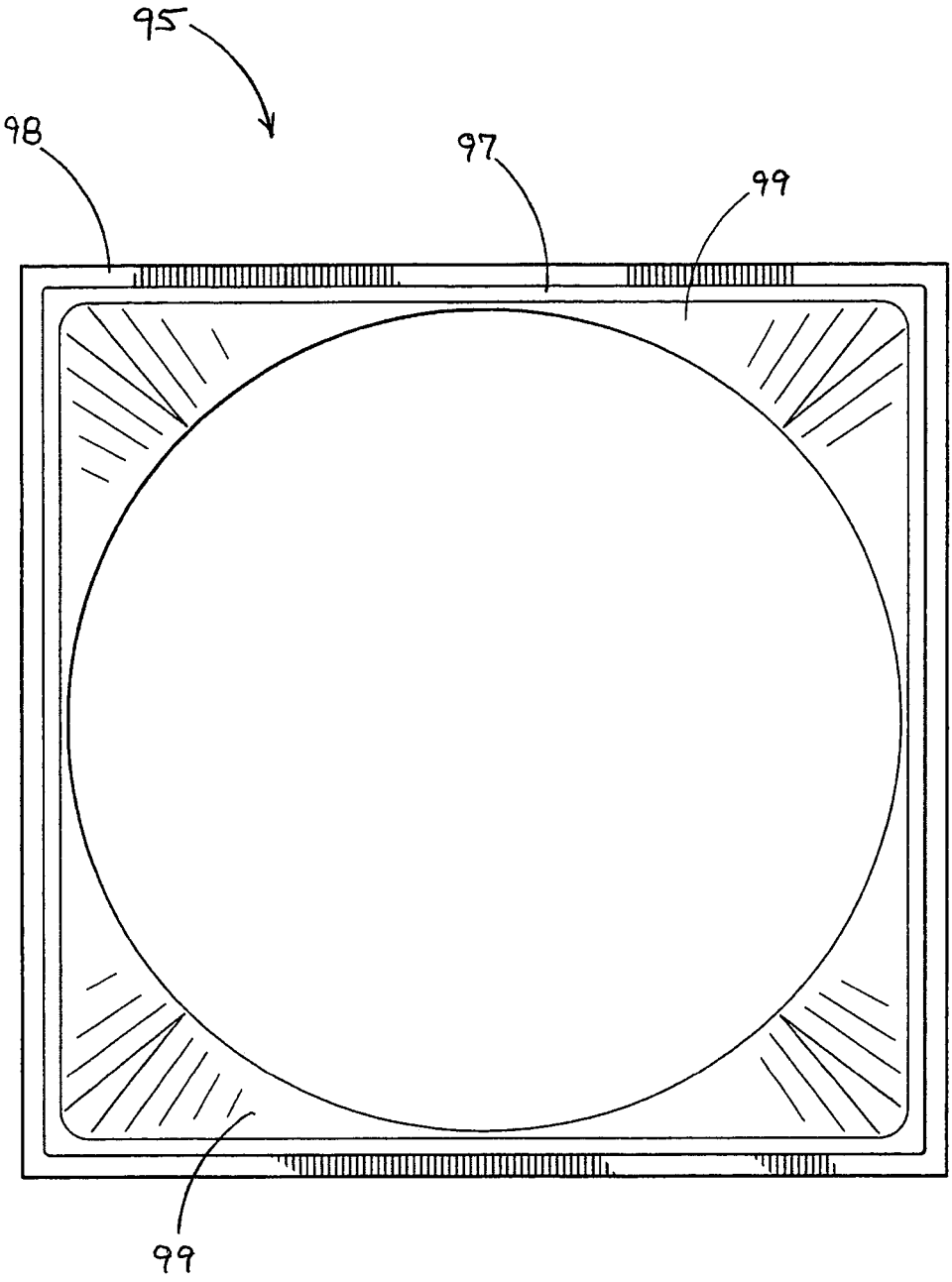
FIG. 8B is a bottom view of the embodiment of the lower adaptor box of FIG. 8A.
Figure 8C:
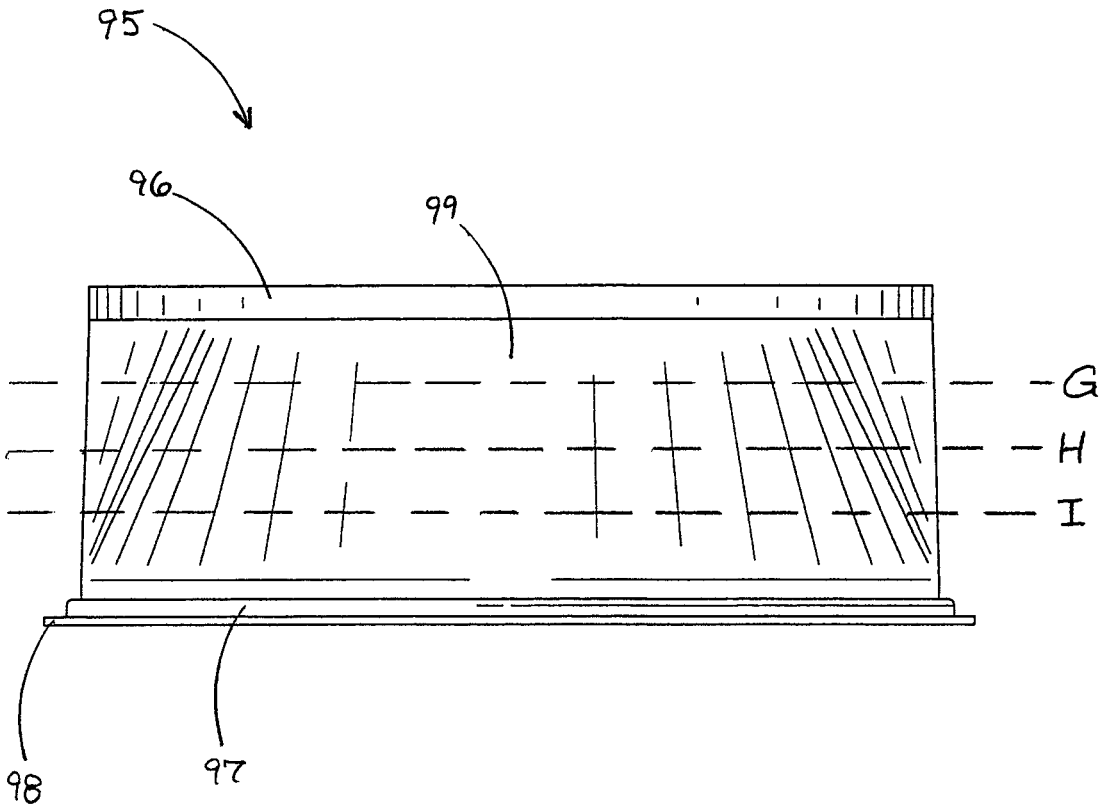
FIG. 8C is a side view of the embodiment of the lower adaptor box of FIG. 8A.

A lower adaptor box 95 is carried by the lower end of displacement absorber 80. One embodiment of a lower adaptor box 95 is depicted in FIGS. 8A, 8B, and 8C. Lower adaptor box 95 conveys light from displacement absorber 80 toward the building interior. Lower adaptor box 95 includes upper end 96, diffuser receptacle 97, and walls 99 disposed between upper end 96 and diffuser receptacle 97. Upper end 96 is configured for attachment to the bottom of displacement absorber 80, and as depicted in FIGS. 8A, 8B, and 8C, upper end 96 has a round cross-section. Other geometries, however, may be used to mate with the bottom of displacement absorber 80 as required.

Flange 98 is disposed about the perimeter of diffuser receptacle 97 of lower adaptor box 95 in the embodiment shown in FIGS. 8A, 8B, and 8C. Flange 98 is preferably configured for placement in standard dimensions of suspended ceiling grids 29 (FIG. 2). Additionally, or optionally, flange 98 may be configured for placement against interiorly exposed, finished surfaces, such as sheet rock, serving a trim ring, a trim frame, or a mount for a trim ring or trim frame, in installations involving sheet rock rather than grid ceilings. Diffuser receptacle 97 is adapted for receipt of a diffuser panel of complementary size and shape (not shown) that allows light to enter the interior of a building room from skylight assembly 20.

In one embodiment, it has been found desirable to configure the walls 99 of lower adaptor box 95 to be nonplanar. As such, any cross-sectional evaluation of walls 99, such as at locations denominated as planes G, H, or I in FIG. 8C, would reveal a curvilinear geometry. So configured, lower adaptor box 95 has been found to transmit light to the interior of a building with less differential lighting, fewer "hot spots," and fewer regions of greater and lesser light intensity upon the diffuser, instead providing a more pleasing and even distribution of light upon the diffuser panel.

Skylight assembly 20 also may include means for secondarily securing the skylight assembly to the building roof, for example for compliance with governmental requirements that mandate withstanding certain earthquake forces. Cabling 90 may be provided in skylight assembly 20 for such secondary securement. As shown in FIGS. 1 and 2, cabling 90 may extend from attachment to a roof rafter 27 to the lower end of light tube 70. Both attachments may be by conventional methods. Alternatively, metal strapping or roping may be used in place of cabling 90. As depicted in FIGS. 1 and 2, cabling 90 may also traverse from its attachment to light tube 70 and be loosely extended to lower adaptor box 95, such loose extension allowing lower adaptor box 95 to seat within suspended ceiling grid 29 while preventing lower adaptor box 95 from further downward movement in the event an earthquake or other force causes collapse of suspended ceiling grid 29.

Cabling 90 may also be used to retain displacement absorber 80 and lower adaptor box 95 in place in during construction, as will be explained in more detail below.

Assembly

With a rough opening first cut through a building roof, including through roof sheathing 26 from the exterior, installation of much of skylight assembly 20 into the building may be by several methods by tradesmen still upon the exterior roof, among which are the following exemplary methods.

With angular orientation E between upper section 53 and lower section 54 configured at approximately 180°, top elbow 50 may be inserted through collar 30, the bottom end of top elbow 50 opposite flange 51 inserted first. As top elbow 50 is pushed through collar 30, shoulder 52 or dimples 52', as may be the case in a particular situation, come to bear against inner lip 32. Because top elbow 50 may be constructed of somewhat flexible material, such as for example sheet aluminum, sheet steel, or plastic, some temporary deflection of top elbow 50 allows passage of shoulder 52 or dimples 52' past inner lip 32, until upper flange 51 of top elbow 50 abuts against inner lip 32 of collar 30. Shoulder 52 or dimples 52' may be disposed in manufacture a predetermined distance from upper flange 51, such that when upper flange 51 abuts against inner lip 32, shoulder 52 or dimples 52' likewise abut against ledge 35, at which point collar 30 is properly installed within collar 30. Collar 30 and flashing 40 are preferably shipped together by the manufacturer, with silicone sealing already applied between them. Alternatively, flashing 40 may be slipped upon top elbow 50, from the bottom of top elbow 50 and worked toward its top until annulus 41 is held against upper section 53 by collar 30. Further alternatively, collar 30 may itself also include flashing features adapted for the carrying of the skylight assembly 20 by the roof and for weatherproofing thereof as to the roof without use of flashing 40.

Upper light tube 60 and lower light tube 70 may have been shipped together in "knocked down" condition from the manufacturer, with lower light tube 70 telescoped within upper light tube 60, for economy of packaging and shipping, and to minimize opportunity for incorrect assembly in the field. As already described, lower light tube 70 may also optionally include second interlock 73, which prevents mistaken disassembly of light tube 70 from light tube 60. Top elbow 50 having been installed within collar 30, upper light tube 60, with lower light tube 70 telescoped within it, may be attached to the lower end of top elbow 50. Such attachment may be by screws, rivets, brads, or like techniques known in the art. During such attachment, lower light tube 60 is prevented from falling from the bottom of upper light tube 70 by engagement of female interlock 61 with male interlock 71 or interlock 71'.

In installations involving greater distances to be traversed by skylight assembly 20, additional light tubes may be serially attached to the bottom of second light tube 70, by screws, rivets, brads, and the like. For example, a second telescoping light tube assembly, constructed of a second set of first light tube 60 and second light tube 70, may be serially attached to the first set described above, for greater telescopic expansion in traversing such distance. Alternatively, as may be required only a single additional light tube may be attached to the bottom of second light tube 70, the telescopic adjustment of light tubes 60, 70 providing the required expandability needed.

Displacement absorber 80 may be attached, with upper band 85, to the lower end of lower light tube 70, by screws, rivets, brads, or like techniques known in the art. Also, screw eyes (not shown) may be attached to the lower portion of light tube 70, for later receipt of cabling 90. If additional telescoping assemblies are required, as described in the preceding paragraph, it has been found useful to attach such cabling 90 to the lowermost of such interconnected tubes, for stability in lowering the subassembly through the rough opening as will now be described.

At any point during the foregoing assembly after installation of top elbow 50 into collar 30, upper section 53 and lower section 54 of top elbow 50 may be rotated relative to each other to provide appropriate angular orientation E of lower section 54 toward a target location of the building ceiling below. Likewise, the abutment of upper flange 51 of top elbow 50 with inner lip 32 of collar 30, and the abutment of shoulder 52 or dimples 52' of top elbow 50 with ledge 35 of collar 30, allow top elbow 50 to be rotated within collar 30 to provide appropriate directional orientation of lower section 54 toward such target location of the ceiling below.

Exterior dome 25 may be attached to collar 30, either by predetermined snap fit configuration or by the use of mechanical clips.

With exterior dome 25, collar 30, flashing 40, top elbow 50, upper light tube 60, lower light tube 70 (and such additional, serially-connected light tubes as necessary), and displacement absorber 80 so interconnected, the subassembly may be inserted through the hole in the roof from the outside of the building. Engagement of female interlock 61 with male interlock 71, 71' will prevent lower light tube 70 and displacement absorber 80 from falling from the bottom of upper light tube 70 into the building, and maintain the structure so assembled.

At such point, or later, flashing 40 may be affixed to curb 28, if a rooftop curb is used, or may be sealed to surrounding roofing systems if no curb is used.

Exterior installation steps having thus been completed, lower adaptor box 95 may be attached to the displacement absorber from inside the building, for example with lower band 86. Once the approximate final location of the lower adaptor box 95 is determined, even in the absence of ceiling rafters or a suspended ceiling grid, screws 72 (FIGS. 6A, 6B) may be installed between upper light tube 60 and lower light tube 70 to fix the telescopic length of the two light tubes together to meet the particular dimensional requirements of the building at hand.

Cabling 90 may then be installed from a roof rafter to a lower light tube, for example lower light tube 70, and thereby provide earthquake resistance means for secondarily securing the skylight assembly to the building roof.

Figure 9:
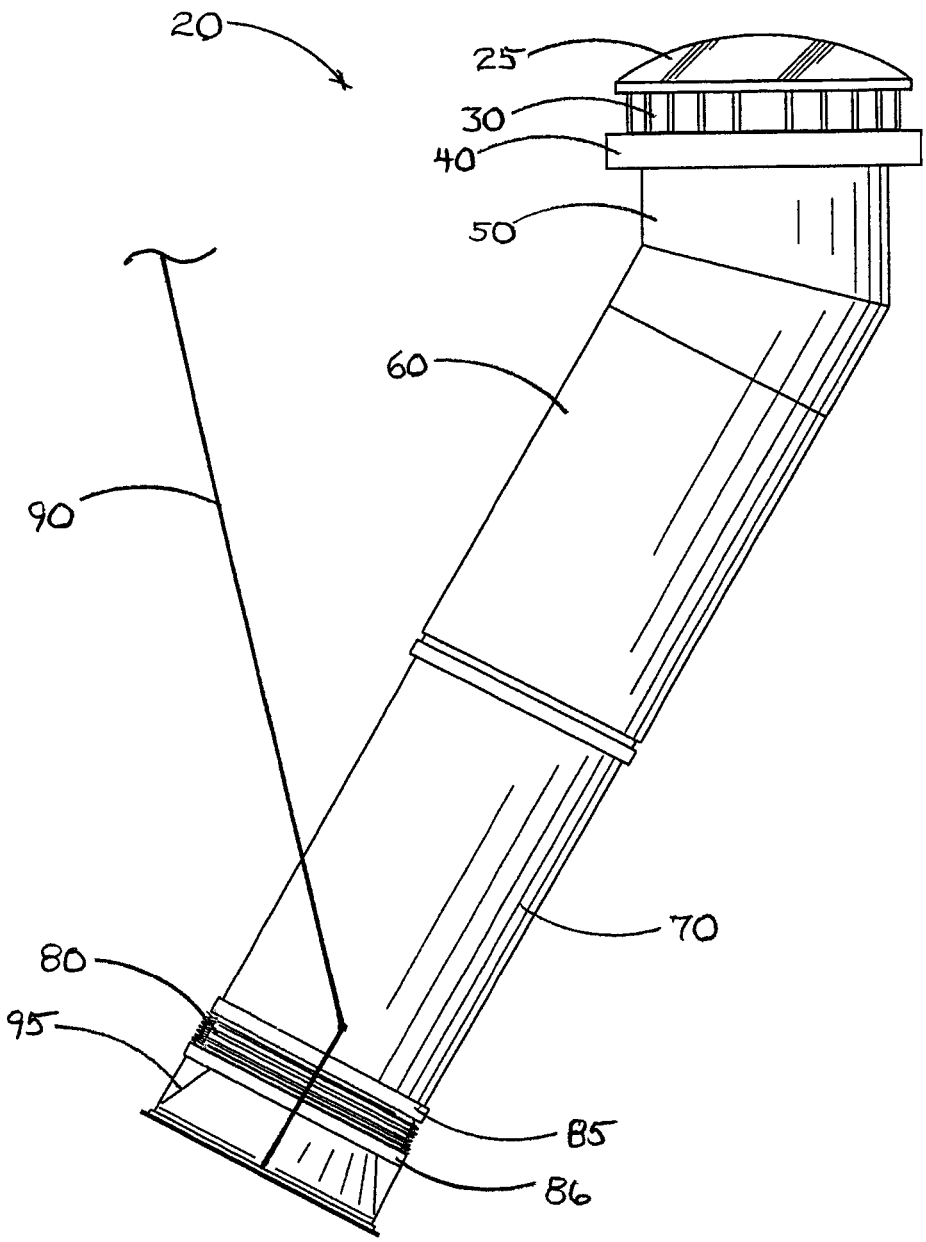
FIG. 9 is a side view of one embodiment of a skylight assembly in accordance with the present invention, with the displacement absorber greatly compressed and with the lower adaptor box held by cabling for later placement in a ceiling.

In locations in which final placement of lower adaptor box 95 into a ceiling (not shown) or into a suspended ceiling grid 29 (FIG. 2) is not at that time desirable, cabling 90 may be further extended from upper band 85 past displacement absorber 80 to lower adaptor box 95 and fixed to compress displacement absorber 80 and lift lower adaptor box 95 out of the way, as depicted in FIG. 9. Such configuration might be desirable in buildings in which skylight assembly 20 has been installed prior to installation of a finished ceiling (not shown) or a suspended ceiling grid 29. After subsequent installation of a finished ceiling or suspended ceiling grid 29, cabling 90 may then be loosened from lower adaptor box 95 to allow final placement of lower adaptor box 95. In finished installations, such as depicted in FIG. 2, cabling 90 may be loosely strung from upper band 85 and attached to flange 98 of lower adaptor box 95, to protect against falling of lower adaptor box 95 and displacement absorber 80 in the event of collapse of a ceiling or a suspended ceiling grid.

While the particular skylight with displacement absorber and interlocking telescoping tubes as herein shown and described in detail is fully capable of attaining the objects of the invention, it is to be understood that it is the presently preferred embodiment of the present invention and is thus representative of the subject matter that is broadly contemplated by the present invention. It is to be further understood that the scope of the present invention fully encompasses other embodiments that may become obvious to those skilled in the art. It is intended that the present invention include such modifications and variations as come within the scope of the appended claims and their equivalents, in which reference to an element in the singular is not intended to means "one and only one" unless explicitly so stated, but rather "one or more."

What is claimed is:

1. A tubular skylight assembly for use in a building having a roof and a ceiling, comprising:

a collar adapted for securement to the roof, the collar defining an opening therethrough, the collar including a condensation collection gutter;

a light transmitting exterior dome, the exterior dome attached to the collar, the dome configured for covering at least the opening defined through the collar;

a top elbow, the top elbow secured to the collar and depending therefrom;

a first light tube, the first light tube secured at one end to the top elbow, the first light tube having an outside wall and an inside wall defining an opening through the first light tube, the inside wall being reflective for the transmission of light therethrough;

a second light tube, the second light tube having an outside wall and an inside wall defining an opening through the second light tube, the inside wall being reflective for the transmission of light therethrough;

one of the first or second light tubes telescopically residing in the other;

the first and second light tubes including interlocks located thereon configured such that engagement between the interlocks limits telescopic movement of the second light tube relative to the first light tube; and a displacement absorber, the displacement absorber bendable, compressible, and expandable, the displacement absorber carried by one of the first or second light tubes opposite the top elbow.

2. The tubular skylight assembly of claim 1, wherein said condensation collection gutter includes drain holes.

3. A tubular skylight assembly for use in a building having a roof and a ceiling, comprising:

a collar adapted for securement to the roof, the collar defining an opening therethrough;

a light transmitting exterior dome, the exterior dome attached to the collar, the dome configured for covering at least the opening defined through the collar;

a top elbow, the top elbow secured to the collar and depending therefrom, the top elbow-including limiting means for limiting the top elbow from downward movement relative to the collar upon attachment of the top elbow with the collar the top elbow further including a top end and further comprising a flare disposed upon the top end, the flare adapted to abut the collar at a predetermined location of the collar about the top elbow;

a first light tube, the first light tube secured at one end to the top elbow, the first light tube having an outside wall and an inside wall defining an opening through the first light tube, the inside wall being reflective for the transmission of light therethrough a second light tube, the second light tube having an outside wall and an inside wall defining an opening through the second light tube, the inside wall being reflective for the transmission of light therethrough;

one of the first or second light tubes telescopically residing in the other;

the first and second light tubes including interlocks located thereon configured such that engagement between the interlocks limits telescopic movement of the second light tube relative to the first light tube;

a displacement absorber, the displacement absorber bendable, compressible, and expandable, the displacement absorber carried by one of the first or second light tubes opposite the top elbow.

4. A tubular skylight assembly for use in a building having a roof and a ceiling, comprising:

a collar adapted for securement to the roof, the collar defining an opening therethrough;

a light transmitting exterior dome, the exterior dome attached to the collar, the dome configured for covering at least the opening defined through the collar;

a top elbow, the top elbow secured to the collar and depending therefrom, the top elbow-including limiting means for limiting the top elbow from downward movement relative to the collar upon attachment of the top elbow with the collar, the top elbow further including a top end and further comprising an interlock adjacent to the top end, the interlock adapted to engage the collar at a predetermined location of the collar about the top elbow;

a first light tube, the first light tube secured at one end to the top elbow, the first light tube having an outside wall and an inside wall defining an opening through the first light tube, the inside wall being reflective for the transmission of light therethrough;

a second light tube, the second light tube having an outside wall and an inside wall defining an opening through the second light tube, the inside wall being reflective for the transmission of light therethrough;

one of the first or second light tubes telescopically residing in the other;

the first and second light tubes including interlocks located thereon configured such that engagement between the interlocks limits telescopic movement of the second light tube relative to the first light tube;

a displacement absorber, the displacement absorber bendable, compressible, and expandable, the displacement absorber carried by one of the first or second light tubes opposite the top elbow.

* * * * *